United States Patent [19]

Potter

[11] Patent Number: 4,831,921

[45] Date of Patent: May 23, 1989

[54] SPINDLE BEARING ASSEMBLY FOR TURBINE VENTILATOR

[75] Inventor: Paul S. Potter, Dallas, Tex.

[73] Assignee: Clark United Corporation, Dallas, Tex.

[21] Appl. No.: 198,773

[22] Filed: May 24, 1988

[51] Int. Cl.[4] ..... F23L 17/02

[52] U.S. Cl. ..... 98/75; 384/539; 384/617

[58] Field of Search ..... 98/72, 75; 384/537, 384/617, 620, 539

[56] References Cited

U.S. PATENT DOCUMENTS

| | | | |
|---|---|---|---|
| 1,613,666 | 1/1927 | Lighthart | 98/72 |
| 2,194,817 | 3/1940 | Boiv | 384/537 |
| 2,690,364 | 9/1954 | Buckwalter | 384/617 |
| 3,179,367 | 4/1965 | Rapata | 248/239 |
| 3,392,659 | 7/1968 | Rousey | 98/72 |
| 3,590,720 | 7/1971 | Siegal | 98/75 |
| 4,046,436 | 9/1977 | Brown | 384/617 |
| 4,441,347 | 4/1984 | Taylor | 70/370 |
| 4,653,708 | 3/1987 | Rich | 248/27.1 |
| 4,685,172 | 8/1987 | O'Conner | 384/537 X |
| 4,765,762 | 8/1988 | Rozentals | 384/539 |

FOREIGN PATENT DOCUMENTS

| | | | |
|---|---|---|---|
| 2056 | 3/1899 | United Kingdom | 98/75 |

*Primary Examiner*—Harold Joyce
*Attorney, Agent, or Firm*—Dennis T. Griggs

[57] ABSTRACT

A wind powered turbine ventilator is disclosed in which a turbine head is rotatably supported about a tubular base through which air flow is to be induced. For supporting the head for rotation, there is provided a sleeved ball bearing housing coaxially secured in a bidirectional interlock to a relatively stationary mounting plate and through which an axial spindle extends. Also disclosed is a subassembly of the bearing housing secured to the mounting plate in the bidirectional interlock.

11 Claims, 2 Drawing Sheets

SPINDLE BEARING ASSEMBLY FOR TURBINE VENTILATOR

FIELD OF THE INVENTION

This invention relates to bearing structures, and in particular to a bearing lock assembly for supporting the spindle of a wind powered turbine ventilator and bearing structures therefor.

BACKGROUND OF THE INVENTION

Turbine ventilators are widely used for under-roof ventilation in domestic, commercial and industrial applications. Their popularity stems largely from a relatively modest purchase cost coupled with a substantial absence of any operating cost and ability to operate without regulation. That is, the primary purpose of the turbine ventilator is to exhaust under-roof accumulation of hot air either internally generated or as a result of sun load on the roof. For that purpose, a precise quantity of air flow need not be maintained continuously but can instead be permitted to fluctuate within a wide range.

Being wind powered, capacity fulfillment of the turbine ventilator to induce a forced air flow upward through a roof opening is dependent upon and will fluctuate extensively in correlation to ambient wind velocity. Continuous exposure to varying wind and rotational forces subjects the ventilator and its bearing supports to severe vibration and wear.

DESCRIPTION OF THE PRIOR ART

Wind powered turbine ventilators are available in various sizes affording a rated flow capacity at a given wind velocity. Their construction usually includes a vaned head mounted for rotation relative to a stationary base. The base is adapted to be secured to a roof over an opening provided therein in communication with the space to be ventilated. Exterior bracing may be provided to aid in securing the components relative to each other while an axially depending internal spindle in cooperation with a stationary sleeve provides a journalled support for rotation.

It is desirable in such constructions to minimize resistance to rotation since any reduction in rotational velocity at a given wind velocity decreases the ability of the turbine ventilator to perform at its rated capacity. Upper and lower bearings at each end of the spindle are used in most turbines to reduce such resistance. Wind loading has in some instances caused the spindle bearings to become unseated or loosen, which increases frictional drag forces and may cause uneven bearing wear. Such structural failure frequently results in the entire ventilator unit being discarded and replaced.

Exemplifying turbine ventilators of the prior art are the disclosures of U.S. Pat. Nos. 3,392,659 and 3,590,720. Exemplifying specific support structures for a variety of interlocking items are the disclosures of U.S. Pat. Nos. 3,179,367; 4,441,347; and 4,653,708.

OBJECTS OF THE INVENTION

It is a general object of the invention to provide an improved wind actuated turbine ventilator structure for effecting under-roof ventilation.

A related object of the invention to provide a bearing housing lock for a turbine ventilator having improved operational reliability and a significantly extended operational life expectancy as compared to bearing constructions in turbine ventilators of the prior art.

Yet another object of the invention to provide an improved bearing housing assembly for a turbine ventilator that can better withstand vibrational effects while permanently retaining its secured relation with respect to a spindle with which it cooperates.

SUMMARY OF THE INVENTION

The foregoing objects are achieved in accordance with the invention by means of a bearing housing lock and an annular mounting plate concentrically supported internally within a turbine head. An aperture in the mounting plate is centered between a plurality of L-shaped arcuate slots in which a self-contained ball bearing housing can be secured thereto in a bidirectional interlock. The bearing housing is adapted, when mounted, to be positioned coaxially with the center aperture and includes an inner race having a central opening through which a stationary depending spindle extends.

For attachment to the mounting plate, the housing includes a plurality of arcuately spaced integral projection tabs that cooperate with the slots and with each other to both interlock with and oppositely grip the mounting plate forcibly therebetween. The projection tabs each include an arcuate resilient arm terminating at its distal end in a depending pad and a separate downward and radially extending foot arcuately spaced from the arm. The foot is initially placed through the oversized slot opening while the pad engages the top surface of the plate. By relative rotation, the foot enters the narrow portion of the L-slot for engaging the underside of the plate until the pad snaps into the larger opening of the L-slot against an opposite edge, to effect the bidirectional interlock and prevent a reverse rotation.

Because the undersurface of the pad in its normal unmounted state extends to a plane slightly offset from the upper surface plane of the foot in combination with the resilient feature of the arm tab, the arm in cooperation with the foot tab on the underside of the plate imposes a gripping detent engagement of the mounting plate therebetween. The bidirectional interlock and gripping action secures the bearing housing within its aligned, spindle seated position.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
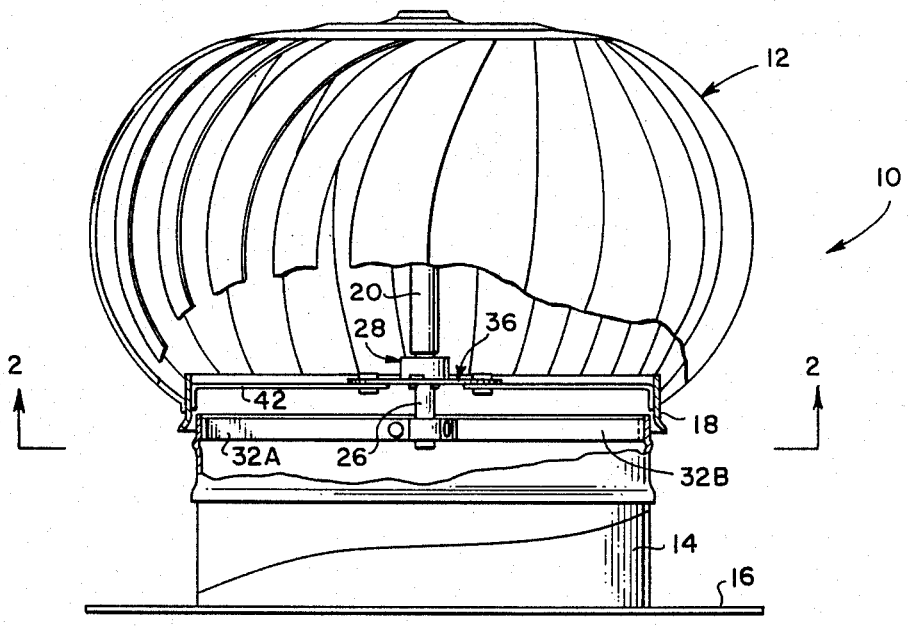
FIG. 1 is a partially broken away, elevational view of a turbine ventilator apparatus having a spindle supported by the bearing lock assembly of the present invention.

In the description which follows, like parts are marked throughout the specification and drawings with the same reference numerals, respectively. The drawing figures are not necessarily to scale and the proportions of certain parts have been exaggerated for purposes of clarity.

Referring now to the drawings, a turbine ventilator 10 has a vaned turbine rotor head 12 adapted to be rotated about an adjustably sectioned tubular base 14. The base includes a flange 16 extending about its lower end by which it ca be secured and flashed over an apertured roof area. The underside of turbine head 12 includes an annular collar 18 concentrically extending about the upper distal end of base 14.

For supporting the turbine head for rotation, there is provided internally of the head a stationary coaxial spindle 20 secured in bore 30 formed between three guide arms 32A, 32B, 32C. At the upper end of the head the spindle extends through a crown bearing (not shown). The lower end of spindle 20 includes a reduced diameter shank 26 that extends through bearing assembly 28 hereof, as will be described, and is received in bore 30 of the centering guide arms 32A, 32B and 32C. The latter includes flanges 34 attachable to the interior wall surface of base 14.

Figure 7:
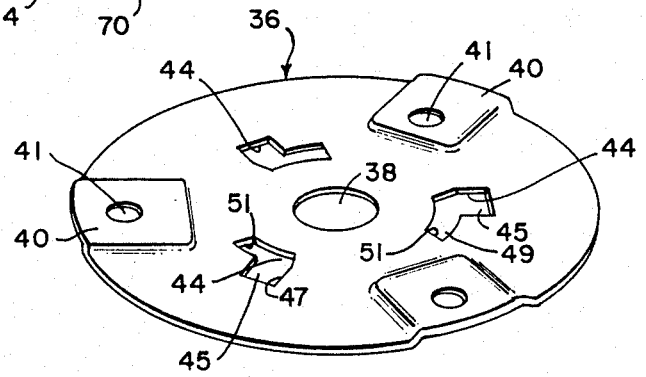
FIG. 7 is a perspective view of the mounting plate shown in FIG. 1; and, FIG. 8 is a fragmentary perspective view of the bearing housing mounted onto the plate shown in FIG. 7.
Figure 8:
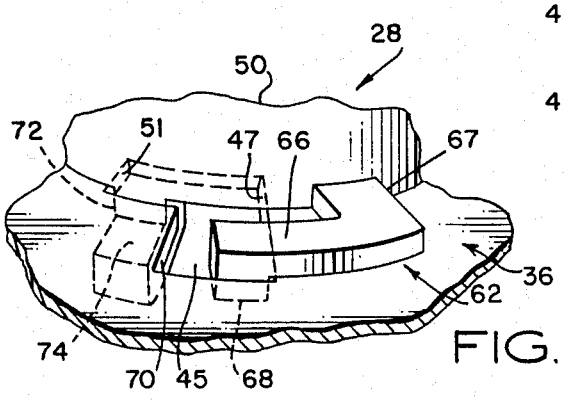

Providing support for bearing assembly 28 in the foregoing relation is a relatively rigid, horizontally placed, mounting plate 36 adapted to be rotated with the turbine head 12. The mounting plate 36 includes a central aperture 38 (FIG. 7) and angularly spaced bosses 40. The bosses are adapted each to receive a rigid brace 42 secured via a fastener 43 (FIG. 2) in aperture 41 and extending radially inward from where secured to the inner surface of head collar 18. Also provided in mounting plate 36 are three arcuately spaced apart L-shaped slots 44 by which the bearing housing 28 is secured thereto. Defining each slot 44 is a larger portion 45 extending from an edge 47 and merging with the narrower portion 49 extending to an edge 51.

Bearing assembly 28, as will now be described with reference to FIGS. 3–6, includes ball bearings 46 secured between an inner race 48 and an outer race 50. Upper and lower flanges 52 and 54 respectively enclose the bearing cavity while annular Teflon ® seals 56 and 58 cooperate with the flanges for preventing entry of dust particles. Centrally extending through the inner race 48 is a sleeve opening 60 in which lower shank 26 of spindle 20 is received.

Figure 3:
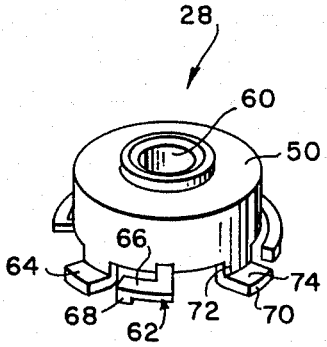
FIG. 3 is a perspective view of the bearing housing shown in FIG. 1.
Figure 4:
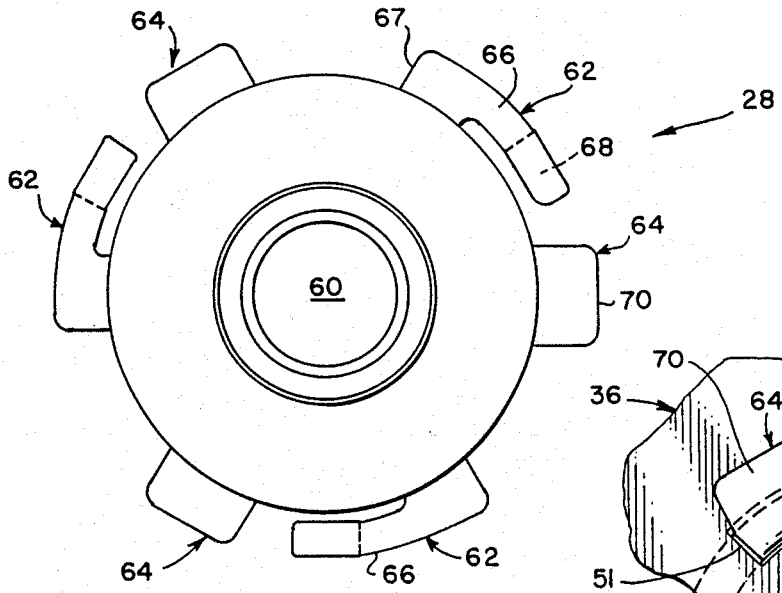
FIG. 4 is a top plan view of the bearing housing.
Figure 5:
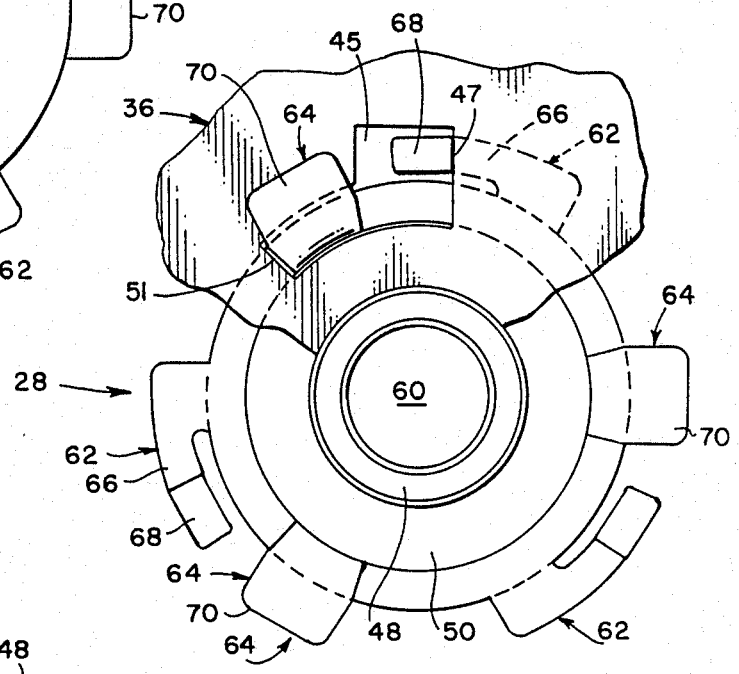
FIG. 5 is a fragmentary bottom plan view of the bearing housing shown assembled onto a mounting plate.
Figure 6:
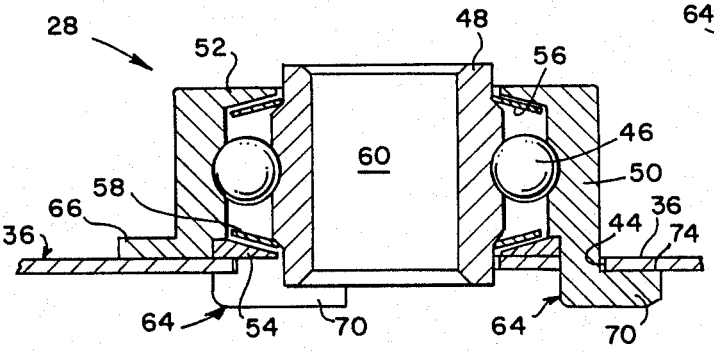
FIG. 6 is a sectional view through the mounted bearing housing.

For mounting the bearing housing securely onto mounting plate 36, there are provided three projection tabs 62 and three flange tabs 64 which project outwardly from outer race 50. Each projection tab 62 has an arcuate arm 66 radially joined at 67 to the exterior of race 50 coplanar with its undersurface. At its distal end, arm 66 includes a downwardly depending pad 68 (FIG. 3). Each flange tab 64 is integrally formed at 72 with the undersurface of housing 50 and has a radial offset foot 70 adapted to be inserted through the larger opening 45 of the plate slot 44.

The foot 70 includes an upper surface 74 adapted when bearing installation is completed to forcibly engage the undersurface of the mounting plate 36. To effect gripping action, the undersurface of arm 66, when the bearing housing is in its unmounted state as illustrated in FIG. 3, is in a plane approximately the same as the plane of the upper surface 74 of foot 70. At the same time, arm 66 by virtue of its cantilevered arrangement affords some degree of resilience about its hinged union at 67.

To install the bearing housing 28 onto plate 36, each foot tab 70 is first inserted through the larger opening 45 of a corresponding plate slot 44. Once all the foot tabs are inserted, the mounting plate 36 and bearing assembly 28 are relatively rotated in a bayonet lock as the depending portion 72 of foot 70 enters the narrow portion 49 of the slots 44. In the course of placing foot tab 70 through opening 45, the arm pad 68 of tab 62 is biased upwardly into a forced engagement against the upper surface of the mounting plate. During the rotational locking step, foot portion 72 is advanced until it engages edge 51 at which time biased pad 68 descends into opening 45 adjacent edge 47. This imposes a firm, bidirectional interlock against further rotation in either direction. At that time the biasing effect of arm 66 draws foot surface 74 into engagement against the undersurface of the mounting plate 36. By virtue of the three bidirectional interlocks and biasing effects of the pads, the pad 68 and foot 70 cooperate to grip mounting plate 36.

Figure 2:
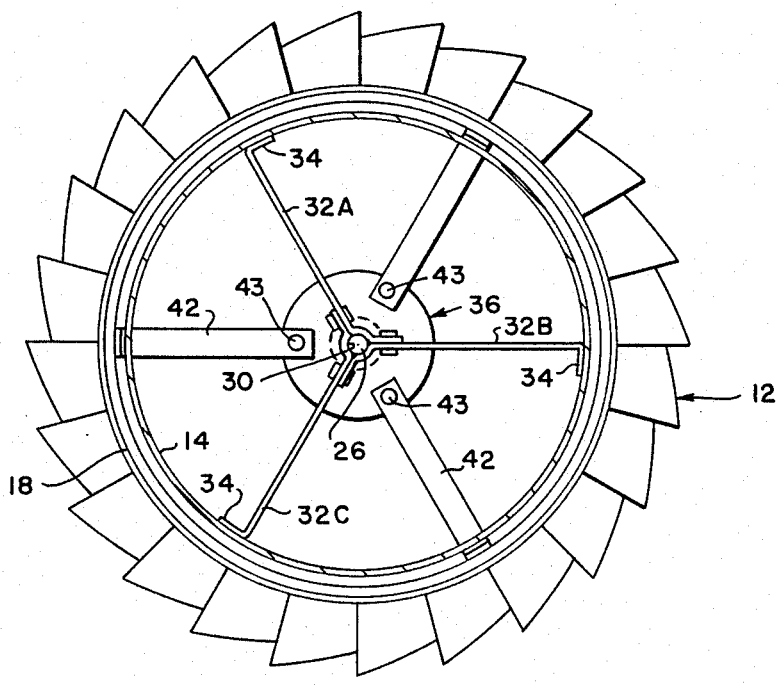
FIG. 2 is a sectional view as seen substantially along the lines 2—2 of FIG. 1.

Prior to the bearing housing and mounting plate being secured in the relationships of FIGS. 1 and 2, the lower spindle shank 26 is positioned so as to extend rotationally secured in bearing sleeve 60 with its distal end secured in guide bore 30.

Upon completion of the foregoing assembly, head 12 is supported for rotation via stationary spindle 20 extending through bearing unit 28. The ball bearing assembly 28 provides considerably greater ease of rotation than a similarly placed journal bearing. Because it is secured by the bidirectional interlock, vibration and side loading forces are reacted without unseating the bearing assembly. Capacity performance of the ventilator is therefore increasingly maximized, and the life expectancy of the bearing support is extended considerably as compared to the journal bearings of the prior art. While it is anticipated that the bearing assembly of the present invention will last the expected life time of the ventilator, the bearing housing via its connections to the mounting plate can nonetheless be forcibly removed from the mounting plate for replacement when necessary By the above description, there is disclosed a wind powered turbine ventilator having an improved bearing interlock structure for securing the bearing assembly against the adverse effects of vibration. For effecting the interlock, the bearing assembly includes three arcuately spaced projection tabspaired with three flange tabs that interfit with L-shaped slots in a mounting plate to effect a bidirectional interlock.

Each projection tab has a resiliently biased arcuate arm integrally extending from the bearing housing and terminating in a depending pad. When assembled, the flange tab extends through the narrow opening of the L-slot engaging the terminal edge of the slot with the upper surface of the flange tab engaging the undersurface of the mounting plate. At the same time, the pad on the arm end of the projection tab 62 penetrates inwardly of the larger opening of the slot engaging the opposite terminal edge while the undersurface of the arm is biased against the upper surface of the mounting plate.

The opposite edge engagements of the respective tabs prevent any bidirectional rotation between the bearing assembly and the mounting plate while their respective surface engagements cooperate to effect a resilient gripping of the intervening plate. The virtues of this construction in the extended operating life of the ventilator that it affords should be readily appreciated by those skilled in the art.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. A wind actuated turbine ventilator comprising, in combination:

a base adapted for surface mounting about an aperture through which a ventilating air flow is to be induced;

a wind responsive turbine head disposed for rotation about an axis;

means supporting said turbine head for rotation relative to said base, said support means including:

an elongated spindle coaxially disposed within said turbine head;

a bearing housing enclosing ball bearings between an inner race and an outer race and defining an axial opening through the inner race in which said spindle is received, said bearing housing including a plurality of first and second spaced apart projection tabs disposed about the periphery thereof;

a substantially rigid mounting plate secured to said base and transversely disposed relative to the turbine head axis of rotation, said mounting plate having an axial opening in which said bearing housing is received; and, said mounting plate including a plurality of apertures in which said first and second projection tabs are received for cooperating with said projection tabs to secure said housing to said mounting plate in a bidirectional interlock with the mounting plate intervening between opposed surfaces of said first and second projection tabs.

2. A turbine ventilator as defined in claim 1 in which said second projection tabs forcibly engage the upper surface of said mounting plate while said first projection tabs forcibly engage the undersurface of said mounting plate, whereby said first and second projection tabs cooperatively impose a gripped engagement of said mounting plate therebetween.

3. A turbine ventilator as defined in claim 1 in which at least one of said first and second projection tabs has a cantilevered arm extending outward from said bearing housing and providing a spring resilience for imposing said gripped engagement.

4. A turbine ventilator as defined in claim 1 in which one of said projection tabs has an enlarged pad depending in a direction toward said mounting plate and said bidirectional interlock is effected by lateral engagement of said pad against the mounting plate edge on one side of said aperture in which it is received.

5. A turbine ventilator as defined in claim 3 in which said arm on said one projection tab emerges from a radial joinder to said bearing housing at a location circumferentially displaced from the other of said projection tabs and extends arcuately to its distal end in a direction toward the other of said projection tabs.

6. A turbine ventilator as defined in claim 1 in which said apertures are arcuately L-shaped for receiving said respective projection tabs adjacent the opposite ends thereof.

7. A bearing assembly as defined in claim 1 in which at least one of said first and second projection tabs has a cantilevered arm extending outward from said bearing housing and providing a spring resilience for imposing said gripped engagement.

8. A bearing assembly as defined in claim 1 in which the projection tab which engages the upper surface of said mounting plate has an enlarged pad depending in a direction toward said mounting plate and said bidirectional interlock is effected by lateral engagement of said pad against the mounting plate edge on one side of the aperture in which it is received.

9. A bearing assembly as defined in claim 8 in which said arm on said one projection tab emerges from a radial joinder to said bearing housing at a location circumferentially displaced from the other of said projection tabs and extends arcuately to its distal end in a direction toward the other of said projection tabs.

10. A bearing assembly comprising, in combination:

a bearing housing including a plurality pairs of first and second projection tabs joined to said housing about the periphery thereof;

a substantially rigid mounting plate having a plurality of apertures adapted to receive said projection tabs to effect a bidirectional interlock between said bearing housing and said mounting plate; and, said mounting plate being disposed between said projection tabs with one of first and second projection tabs forcibly engaging the upper surface of said mounting plate and the other of said projection tabs forcibly engaging the undersurface of said mounting plate, said first and second projection tabs cooperatively imposing a gripped engagement of said mounting plate therebetween.

11. A bearing assembly as defined in claim 10 in which said plate apertures are arcuately L-shaped for receiving said respective projection tabs adjacent the opposite ends thereof.

* * * * *

UNITED STATES PATENT AND TRADEMARK OFFICE

CERTIFICATE OF CORRECTION

PATENT NO. : 4,831,921

DATED : 05/23/89

INVENTOR(S) : Paul S. Potter

It is certified that error appears in the above-identified patent and that said Letters Patent is hereby corrected as shown below:

Column 3, line 16, "ca" should be -- can --.

Column 4, line 49, "sary" should be -- sary. --.

Column 4, line 55, "tabspaired" should be -- tabs paired --.

Signed and Sealed this

Ninth Day of January, 1990

*Attest:*

JEFFREY M. SAMUELS

*Attesting Officer*

*Acting Commissioner of Patents and Trademarks*